US008611796B2

(12) United States Patent
Izawa et al.

(10) Patent No.: US 8,611,796 B2
(45) Date of Patent: Dec. 17, 2013

(54) WET TYPE DEVELOPING APPARATUS COMPRISING AN IMMERSED CLEANSING ARRANGEMENT

(75) Inventors: Hideo Izawa, Narashino (JP); Takao Namiki, Narashino (JP); Junichi Setoyama, Narashino (JP); Kotaro Harada, Narashino (JP); Sumito Mera, Narashino (JP)

(73) Assignee: Miyakoshi Printing Machinery Co., Ltd., Narashino-shi, Chiba (JP)

( * ) Notice: Subject to any disclaimer, the term of this patent is extended or adjusted under 35 U.S.C. 154(b) by 479 days.

(21) Appl. No.: 12/649,650

(22) Filed: Dec. 30, 2009

(65) Prior Publication Data

US 2010/0196055 A1 Aug. 5, 2010

(30) Foreign Application Priority Data

Feb. 4, 2009 (JP) ..... 2009-023519

(51) Int. Cl.
*G03G 15/10* (2006.01)

(52) U.S. Cl.
USPC ..... 399/237; 399/248; 399/249

(58) Field of Classification Search
USPC ..... 399/237, 239, 248, 249
See application file for complete search history.

(56) References Cited

U.S. PATENT DOCUMENTS

| | | | | |
|---|---|---|---|---|
| 5,083,151 | A * | 1/1992 | Honma | 355/406 |
| 5,893,012 | A | 4/1999 | Schubert et al. | |
| 2003/0156858 | A1 | 8/2003 | Berg et al. | |
| 2008/0124645 | A1 * | 5/2008 | Yamanaka et al. | 430/115 |

FOREIGN PATENT DOCUMENTS

| | | | |
|---|---|---|---|
| JP | 55-101971 | A | 8/1980 |
| JP | 7-089627 | A | 4/1995 |
| JP | 7-125187 | A | 5/1995 |
| JP | 2005-106950 | A | 4/2005 |
| JP | 2007-057915 | A | 3/2007 |

OTHER PUBLICATIONS

European Search Report dated Nov. 15, 2010, issued in corresponding European Patent Application No. 10150043.7.

* cited by examiner

*Primary Examiner* — Joseph S Wong
(74) *Attorney, Agent, or Firm* — Westerman, Hattori, Daniels & Adrian, LLP

(57) ABSTRACT

A wet type developing apparatus is disclosed which can eliminate the need to provide a separately built cleansing unit and, moreover, makes it unnecessary to dismount a developer supply unit for its cleansing operation and to perform its subsequent re-mounting operation.

The apparatus in which a developing roller 2 is in rotational contact with a rotating photoconductor drum 1 and an electrostatic latent image made on a surface of the photoconductor drum is developed with a liquid developer 6 supplied onto the developing roller from a developer supply roller 3 whose surface is in part immersed in the liquid developer reserved in a developer reservoir 5, includes a cleansing arrangement, comprising a unit or units 7 and/or 8, which is disposed at a site in the developer reservoir which is always immersed in the liquid developer for cleansing a portion of the developer supply roller which is immersed in the liquid developer.

4 Claims, 2 Drawing Sheets

WET TYPE DEVELOPING APPARATUS COMPRISING AN IMMERSED CLEANSING ARRANGEMENT

TECHNICAL FIELD

The present invention relates to a wet type (aqueous) developing apparatus for use in a wet type electrophotographic printer using a liquid developer.

BACKGROUND ART

In a wet type developing apparatus of this sort, a liquid developer is supplied onto the surface of a developing roller from a developer supply roller whose peripheral surface is in part immersed in the liquid developer. The developer roller is driven in rotational contact with a photoconductor drum whereby an electrostatic latent image made on a surface of the photoconductor drum is developed with the liquid developer. And, the developer supply roller in general is used comprising an anilox roller provided with cellular recesses in the form of a mesh to retain a proper amount of the liquid developer on its surface.

While the toner should be supplied from the developer supply roller onto the developing roller in a proper amount and evenly, there arises a problem with such a developer supply roller that with lapse of time, toner particles and additionally foreign matters tend to adhere on its surface and, as they accumulate in the cells, the supply of the toner onto the developing roller deteriorates gradually in accuracy, deteriorating the printing quality.

For this reason, developer supply rollers of this kind have had to be cleansed periodically.

In conventional methods of cleansing the surface of a developer supply roller in an developing apparatus, the developer supply roller is dismounted from the developing apparatus and then immersed in a detergent, or in the state that it is immersed in a detergent it is given ultrasonic vibrations, or in the state that it is immersed in a detergent it is rubbed with a cleaning member (JP H07-89627 A; JP H07-125187 A).

In these conventional methods, however, it should be noted that each time a developer supply roller in a wet type developing apparatus in an electrophotographic printer requires cleansing, the developer supply roller must be dismounted from the developer apparatus, must then be cleansed, being put in a separately built cleansing unit and must thereafter be re-mounted on the developing apparatus. Problems ensue: the need for the separately built cleansing unit, the need for operations by an operator or operators to dismount, to cleanse and to re-mount the developer supply roller; they are much burdensome in terms of time, labor and economy.

DISCLOSURE OF THE INVENTION

In order to resolve the problems mentioned above, the present invention provides a wet type developing apparatus in which a developing roller is in rotational contact with a rotating photoconductor drum and an electrostatic latent image made on a surface of the photoconductor drum is developed with a liquid developer supplied onto the developing roller from a developer supply roller whose surface is in part immersed in the liquid developer reserved in a developer reservoir, characterized in that the apparatus includes a cleansing arrangement disposed at a site in the said developer reservoir which is always immersed in the said liquid developer for cleansing a portion of the said developer supply roller which is immersed in the said liquid developer.

Specifically, the cleansing arrangement mentioned above may comprise a brush roller for rubbing a portion of the developer supply roller which is immersed in the said liquid developer. The said cleansing arrangement may alternatively comprise an ultrasonic vibrator disposed immersed in the said liquid developer in the said developer reservoir. Still alternatively, the said cleansing arrangement may comprise both a brush roller for rubbing a portion of the developer supply roller which is immersed in the said liquid developer and an ultrasonic vibrator disposed immersed in the said liquid developer in the said developer reservoir.

According to the present invention, it is made possible to cleanse a developer supply roller without dismounting it from, and within, a developing apparatus. Each time a developer supply roller requires cleansing, the need to dismount and re-mount the developer supply roller can be eliminated. Thus, the maintenance work of a wet type developing apparatus is lightened and its workability is improved, increasing its production efficiency.

In addition, the need to provide a separate cleansing unit outside of a developing apparatus is eliminated, achieving the effect of reduction in equipment cost and installation space and further the economical effect of eliminating the need for a detergent which has been needed to cleanse a developer supply roller.

It should further be noted that the developer supply roller can in accordance with the present invention be cleansed regularly or at desired times while the developing apparatus is operated or idled.

DETAILED DESCRIPTION OF THE INVENTION

Figure 1:
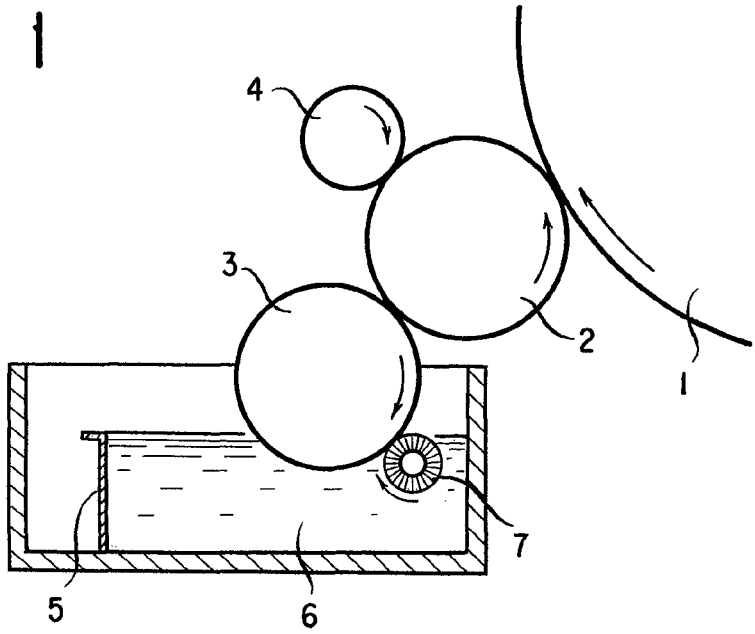
FIG. 1 is a diagrammatic explanatory view illustrating a first form of implementation of the present invention.

Referring now to the drawing Figures, explanation is given of forms of implementation of the present invention.

A wet type developing apparatus according to the present invention is provided with a roller cleansing arrangement which is arranged in a liquid developer in which a developer supply roller is in part immersed whereby a part of surfaces of the developer supply roller that is in part immersed in the liquid developer may always be cleansed.

FIG. 1 shows an apparatus according to a first form of implementation of the invention. The apparatus as is conventional includes a rotating photoconductor drum 1 having a surface exposed to light by an exposure unit (not shown) to make an electrostatic latent image thereon. A developing roller 2 is in rotational contact with the rotating photoconductor drum 1 to develop the electrostatic latent image on the photoconductor drum 1 into a toner image on the developing roller 2 with a liquid developer. The liquid developer is supplied onto the developing roller 2 from a developer supply roller 3. A cleaning roller 4 is brought into rotational contact with the developer roller 2 to clean its surface. The drum 1, roller 2, roller 3 and roller 4 are designed to be rotated synchronously in the directions indicated by the arrows.

The developer supply roller 3 is in part of its surface immersed in the liquid developer 6 held in a developer reservoir 5. As the developer supply roller 3 is rotated, the liquid developer 6 is supplied from the developer reservoir 5 onto the surface of the developing roller 2.

In this first form of implementation according to the present invention, as shown in FIG. 1 a cleansing brush roller 7 is disposed at a site in the developer reservoir 5 which is always immersed in the liquid developer 6 and acts to rub the developer supply roller 3. The cleansing brush roller 7 is adapted to rub a peripheral surface of a portion of the developer supply roller 3 which is always immersed in the liquid developer 6. And, the cleansing brush roller 7 is rotatable in both its normal and reverse directions.

And then, rotating the cleansing brush roller 7 will cause the surface of the developer supply roller 3 to be rubbed in the liquid medium of the liquid developer 6 and thereby cleansed with the liquid developer 6 as a cleansing liquid.

Figure 2:
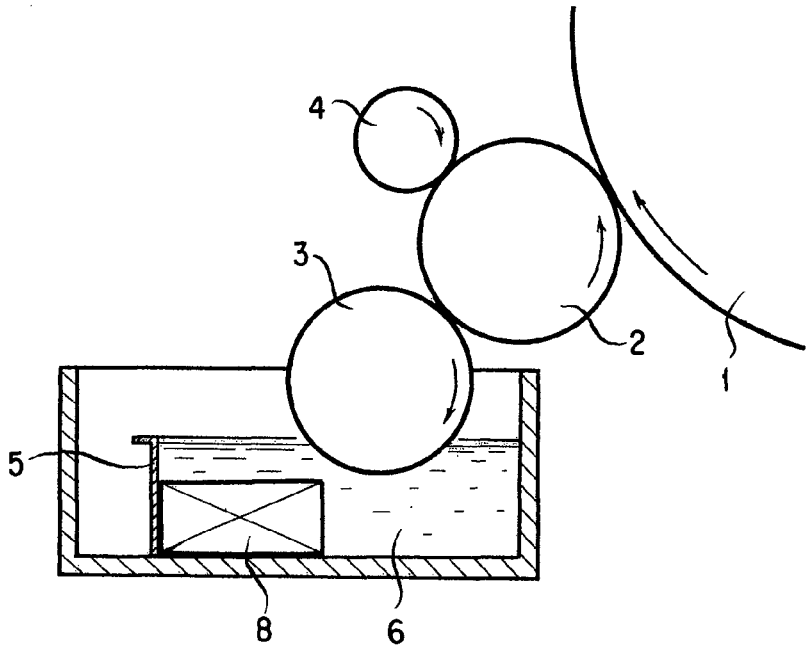
FIG. 2 is a diagrammatic explanatory view illustrating a second form of implementation of the present invention.

FIG. 2 shows a second form of implementation of the invention in which same reference characters are used to designate same components as in FIG. 1 and a repeated description is omitted.

In this second form of implementation of the present invention, there is shown an ultrasonic vibrator 8 which is disposed at a site in the developer reservoir 5 which is always immersed in the liquid developer 6.

And then, by driving the ultrasonic vibrator 8, ultrasonic vibrations generated by the ultrasonic vibrator 8 will cause minute air bubbles to be generated in the liquid developer 6 and these air bubbles impacting on the developer supply roller 3 and generating shock waves to remove toner particles adhered to the surface of a portion of the developer supply roller 3 which is immersed in the liquid developer 6.

This is in contrast to the case of cleansing by ultrasonic vibrations with a detergent in a place (outside of the apparatus) not immersed in the liquid developer 6 where it is known that a wear is caused in cellular portions of an anilox roller. In this form of implementation in which a portion of the developer supply roller 3 which is immersed in the liquid developer 6 is impacted by the minute air bubbles produced by the ultrasonic vibrations, the liquid developer 6 with its viscous property acts as a buffer to diminish the wear, achieving the effect as well in terms of its long life expectancy.

Figure 3:
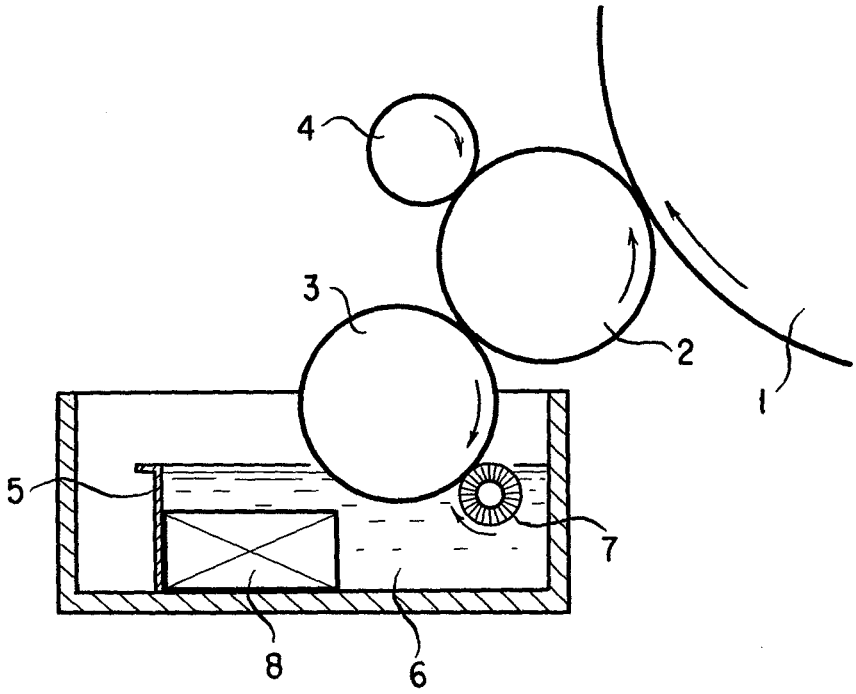
FIG. 3 is a diagrammatic explanatory view illustrating a third form of implementation of the present invention.

FIG. 3 shows a third form of implementation of the invention in which same reference characters are used to designate same components as in FIGS. 1 and 2 and a repeated description is omitted.

This third form of implementation is designed to use the units of the first and second forms of implementation in combination in which the first cleansing unit comprises the cleansing brush 7 adapted to rub a portion of the surface of the developer supply roller 3 which is always immersed in the liquid developer 6 in the developer reservoir 5 and the second cleansing unit comprises the ultrasonic vibrator 8 disposed at a place always immersed in the liquid developer 6.

As for cleansing in each of the forms of implementation mentioned above, the cleansing unit or units may be operated during a printing operation in which the rollers work rotating or synchronously therewith, or at a periodic printer stopping time in which the photoconductor drum 1, the developing roller 2, the developer supply roller 3 and the cleaning roller 4 are idled while in rotation.

Besides an electrophotographic printer, the present invention can be utilized in an electrophotographic copier, a laser printer and a facsimile machine.

What is claimed is:

1. A wet type developing apparatus in which a developing roller is in rotational contact with a rotating photoconductor drum and an electrostatic latent image made on a surface of the photoconductor drum is developed with a liquid developer supplied onto the developing roller from a developer supply roller which is in rotational contact with the developing roller and whose surface is in part immersed in the liquid developer held in a developer reservoir and wherein the entire developing roller is present outside of the developer reservoir, characterized in that the apparatus includes:

a cleansing arrangement disposed at a site in said developer reservoir which is always immersed in said liquid developer for cleansing a portion of said developer supply roller which is immersed in said liquid developer.

2. A wet type developing apparatus as set forth in claim 1, characterized in that said cleansing arrangement comprises a brush roller for rubbing a portion of the developer supply roller which is immersed in said liquid developer.

3. A wet type developing apparatus as set forth in claim 1, characterized in that said cleansing arrangement comprises an ultrasonic vibrator disposed immersed in said liquid developer in said developer reservoir.

4. A wet type developing apparatus as set forth in claim 1, characterized in that said cleansing arrangement comprises both a brush roller for rubbing a portion of the developer supply roller which is immersed in said liquid developer and an ultrasonic vibrator disposed immersed in said liquid developer in said developer reservoir.

* * * * *